US008007346B2

(12) United States Patent
Dehde et al.

(10) Patent No.: US 8,007,346 B2
(45) Date of Patent: Aug. 30, 2011

(54) ELECTRIC HAND-HELD POWER TOOL FOR PERFORMING SANDING WORK, IN PARTICULAR A FINISHING SANDER

(75) Inventors: Joerg Dehde, Steinenbronn (DE); Juergen Hesse, Waldenbuch (DE); Eike U. Von Specht, Magdeburg (DE)

(73) Assignee: Robert Bosch GmbH, Stuttgart (DE)

( * ) Notice: Subject to any disclaimer, the term of this patent is extended or adjusted under 35 U.S.C. 154(b) by 696 days.

(21) Appl. No.: 12/065,747

(22) PCT Filed: Oct. 24, 2006

(86) PCT No.: PCT/EP2006/067721

§ 371 (c)(1),
(2), (4) Date: Mar. 5, 2008

(87) PCT Pub. No.: WO2008/049458

PCT Pub. Date: May 2, 2008

(65) Prior Publication Data

US 2010/0197209 A1 Aug. 5, 2010

(51) Int. Cl.
*B24B 23/00* (2006.01)
*B24B 55/10* (2006.01)
*B24B 41/00* (2006.01)

(52) U.S. Cl. ..... 451/344; 451/356; 451/357; 451/456; 451/494

(58) Field of Classification Search ..... 451/344, 451/354, 356, 357, 358, 359, 456, 490, 494, 451/525

See application file for complete search history.

(56) References Cited

U.S. PATENT DOCUMENTS

| | | | | |
|---|---|---|---|---|
| 4,937,984 | A * | 7/1990 | Taranto | 451/524 |
| 5,470,272 | A * | 11/1995 | Kikuchi et al. | 451/344 |
| 5,967,886 | A * | 10/1999 | Wuensch et al. | 451/356 |
| 6,186,878 | B1 * | 2/2001 | Takizawa et al. | 451/357 |
| 6,394,887 | B1 * | 5/2002 | Edinger | 451/494 |
| 6,527,631 | B2 * | 3/2003 | Wuensch et al. | 451/357 |
| 6,705,931 | B2 * | 3/2004 | Moolenaar et al. | 451/357 |
| 7,040,973 | B1 * | 5/2006 | Kitts | 451/533 |
| 7,485,031 | B1 * | 2/2009 | Stubbs | 451/523 |
| 7,731,573 | B2 * | 6/2010 | Rivard et al. | 451/490 |

FOREIGN PATENT DOCUMENTS

| | | |
|---|---|---|
| DE | 198 00 025 | 9/1998 |
| DE | 101 48 339 | 4/2003 |
| WO | 01/96067 | 12/2001 |

* cited by examiner

*Primary Examiner* — Timothy V Eley
(74) *Attorney, Agent, or Firm* — Michael J. Striker

(57) ABSTRACT

An electric hand-held power tool for performing sanding work, in particular a finishing sander, is provided, that includes a drive plate (16)—which is drivable in a sanding motion using an electric motor—and a sanding plate (21') attached thereto such that it is removable without the use of a tool, with means for attaching a sanding pad (22'). To create a multifunctional device with which various types of sanding work may be performed in an optimal manner, a tub-like recess (23) with a flat tub bottom (231) for receiving the drive plate (16) in a form-fit manner is formed in the top side of the sanding plate (21') facing the drive plate (16); the sanding plate (21') is attached in a manner such that it is removable without the use of tools, preferably via a Velcro attachment between the tub bottom (231) and the surface of the drive plate (16). The easy method of replacing the sanding plate makes it possible to quickly replace sanding plates (21) having different configurations for different requirements on sanding work (FIG. 4).

22 Claims, 5 Drawing Sheets

Figure 1:
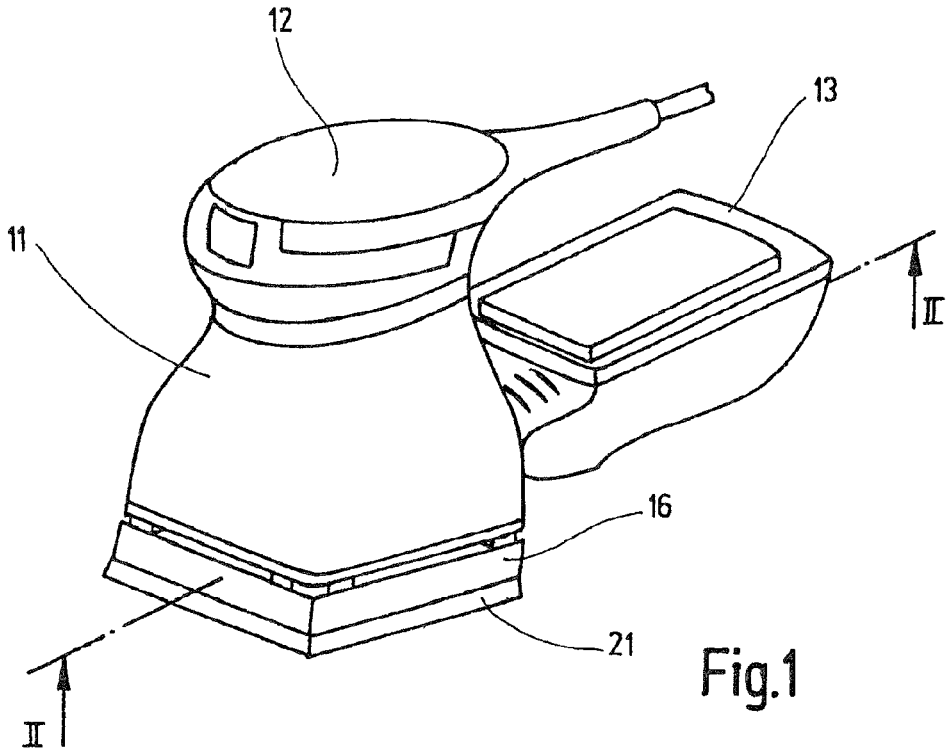

ELECTRIC HAND-HELD POWER TOOL FOR PERFORMING SANDING WORK, IN PARTICULAR A FINISHING SANDER

RELATED ART

The present invention is directed to a hand-held power tool for performing sanding work, in particular a finishing sander, according to the preamble of claim 1.

With a known electric hand-held power tool designed as an eccentric grinder (DE 101 48 339 A1), the circular drive plate is drivable using a roller bearing mounted on an eccentric peg, which is drivable by the output shaft of an electric motor. The sanding plate, which is also circular, includes upwardly projecting spring tabs, on the free ends of which a snap-in hook is formed. When a sanding plate is attached to the drive plate, the spring tabs grip around the outer edge of the drive plate and engage with their snap-in hooks in the snap-in openings formed in the drive plate. The means for attaching the sanding pad to the sanding plate include a Velcro layer attached to the underside of the sanding plate, and a sanding cushion with a velour backing for attachment to the Velcro layer, and with a Velcro coating on the underside—which faces away from the sanding plate—to which a sanding pad is attached. If the Velcro layer of the sanding plate becomes worn, i.e., if it is no longer capable of holding the sanding cushion securely during sanding, the spring tabs may be swiveled manually in order to lift the snap-in hooks out of the snap-in openings, thereby allowing the sanding plate to be lifted off of the working disk and removed from the hand-held power tool, so that it may be replaced with a sanding plate with a sanding cushion.

With another known electric hand-held power tool designed as an eccentric grinder (DE 198 00 025 A1), the drive plate is rotatably supported on a sleeve, which is non-rotatably mounted on the output shaft of an electric motor. The rectangular drive plate is attached such that it may move elastically relative to the machine housing and make an oscillatory motion with superposed orbital oscillation when the electric motor, its drive shaft, and the eccentric sleeve rotate. The sanding plate, which is also rectangular, is detachably attached to the drive plate with screws, and is composed of a rigid, top-side plate and a bottom-side plate made of a soft material. The means for attaching the sanding pad to the sanding plate include a Velcro strip attached to the underside of the bottom-side plate, which, together with the velour backing of a sanding pad, forms an adhesive Velcro connection with the sanding pad.

ADVANTAGES OF THE INVENTION

The inventive electric hand-held power tool having the features of claim 1 has the advantage that the same hand-held power tool may be used to perform different types of sanding work and, given that the sanding plate may be replaced without the use of tools, the hand-held power tool may be adapted in an optimal manner to the sanding work to be performed. With a hand-held power tool designed as a finishing sander in particular, a multifunctional device results, since, simply by replacing the sanding plate, the finishing sander may also be used as a surface sander, corner sander, or edge sander that easily accesses corners and edges. The sanding pad that is used has a rectangular or square shape for surface sanding, a pentagonal or triangular shape for corner and edge sanding, and, for flap sanding, a sanding tab designed as a projecting sanding plate section with a greatly reduced disk thickness. All of the replaceable sanding plate variants are installed on the drive plate of the finishing sander. Due to the tub-shaped recess in the sanding plate, which encloses the polygonal drive plate in a form-fit manner, all of the forces that act parallel to the plane of the workpiece surface to be worked are transferred reliably and largely without wear. Forces that result perpendicularly to the drive plate, which are caused, e.g., by the sanding plate being pressed against the workpiece, are easily transferred via the drive plate located on the tub bottom to the sanding plate. As a result, the attachment—which is preferably realized as a Velcro attachment—of the sanding plate via the tub bottom to the lower plate surfaces of the drive plate ensures that the sanding plate remains on the hand-held power tool when the hand-held sander is lifted away from the surface of the workpiece, or during any type of handling of the machine other than sanding.

Via the measures listed in the further claims, advantageous refinements and improvements of the electric hand-held power tool described in claim 1 are made possible.

DRAWING

The present invention is described in greater detail in the description below with reference to exemplary embodiments shown in the drawing.

Figure 2:
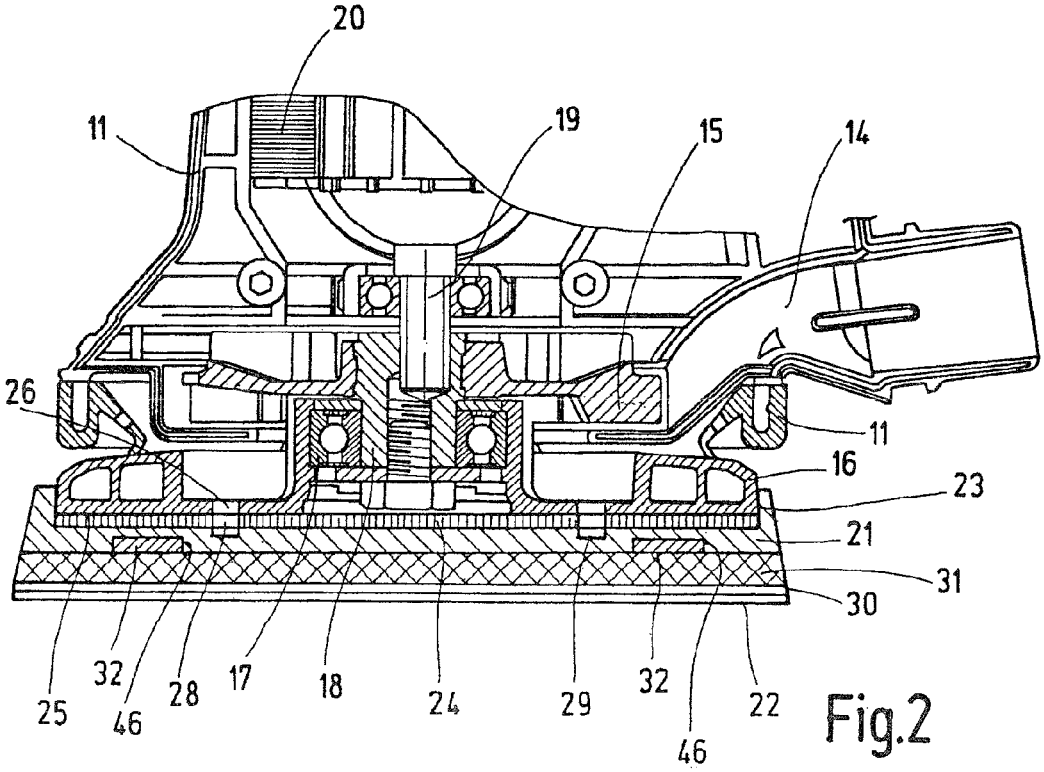
Figure 3:
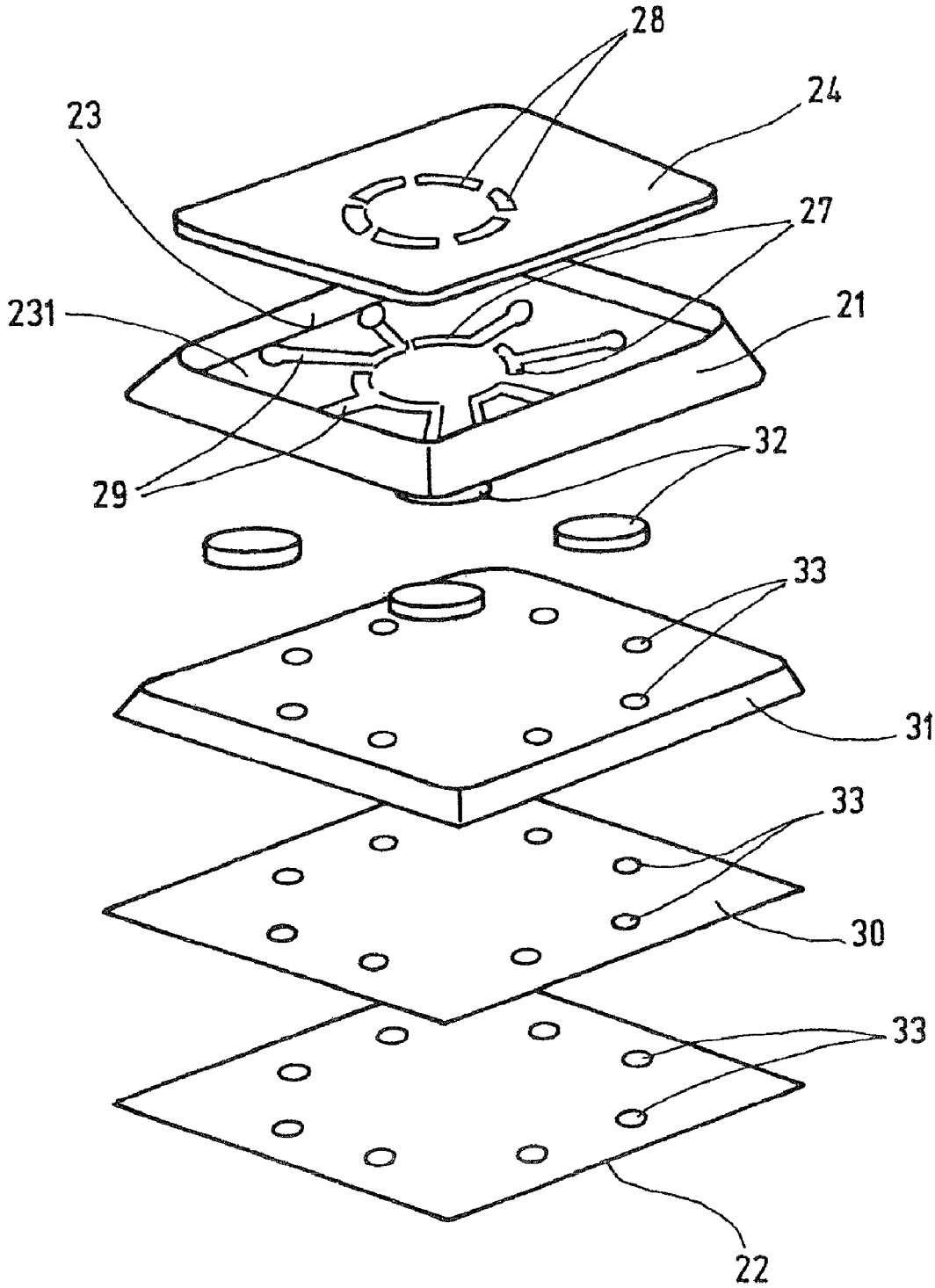
Figure 4:
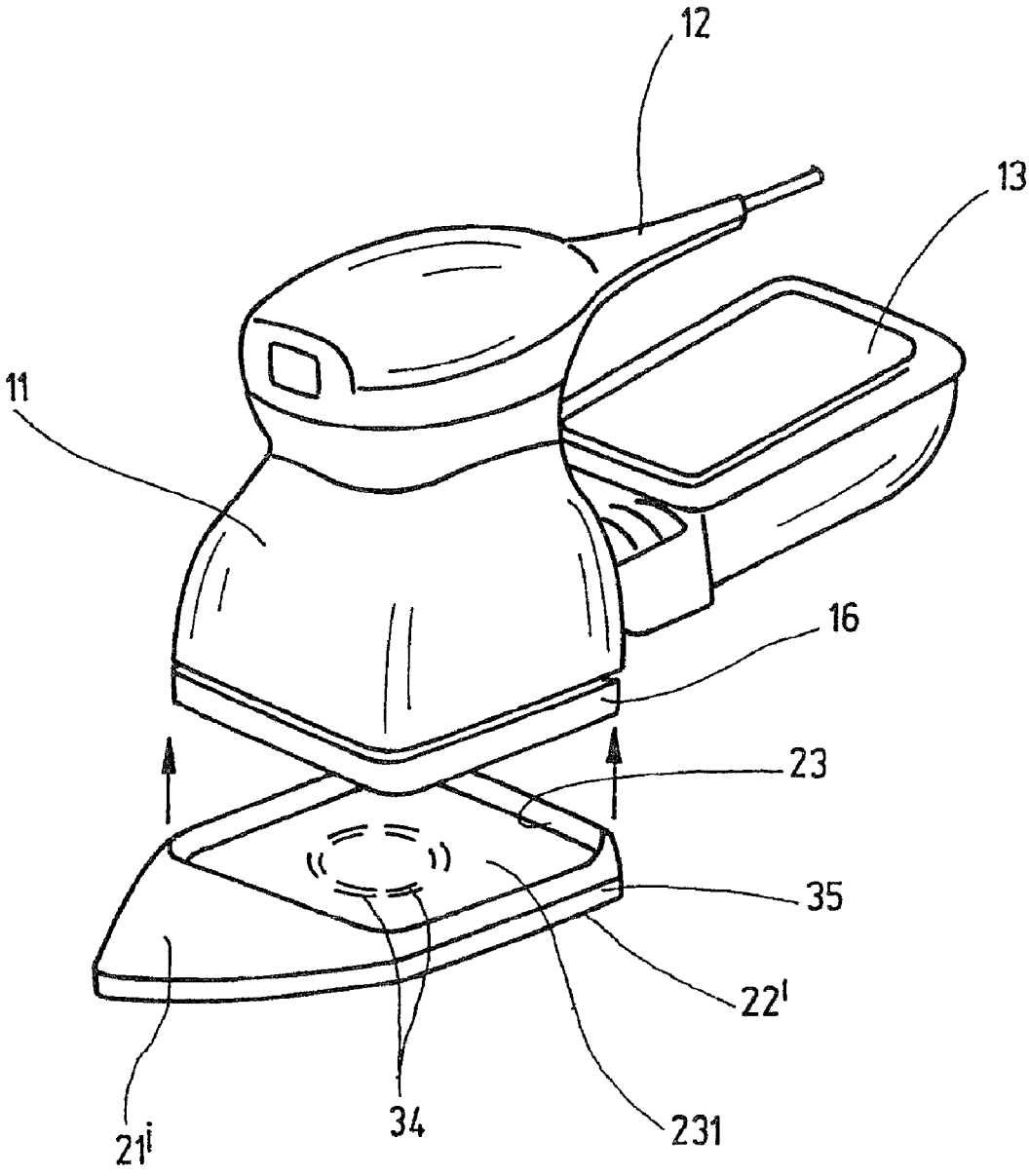
Figure 5:
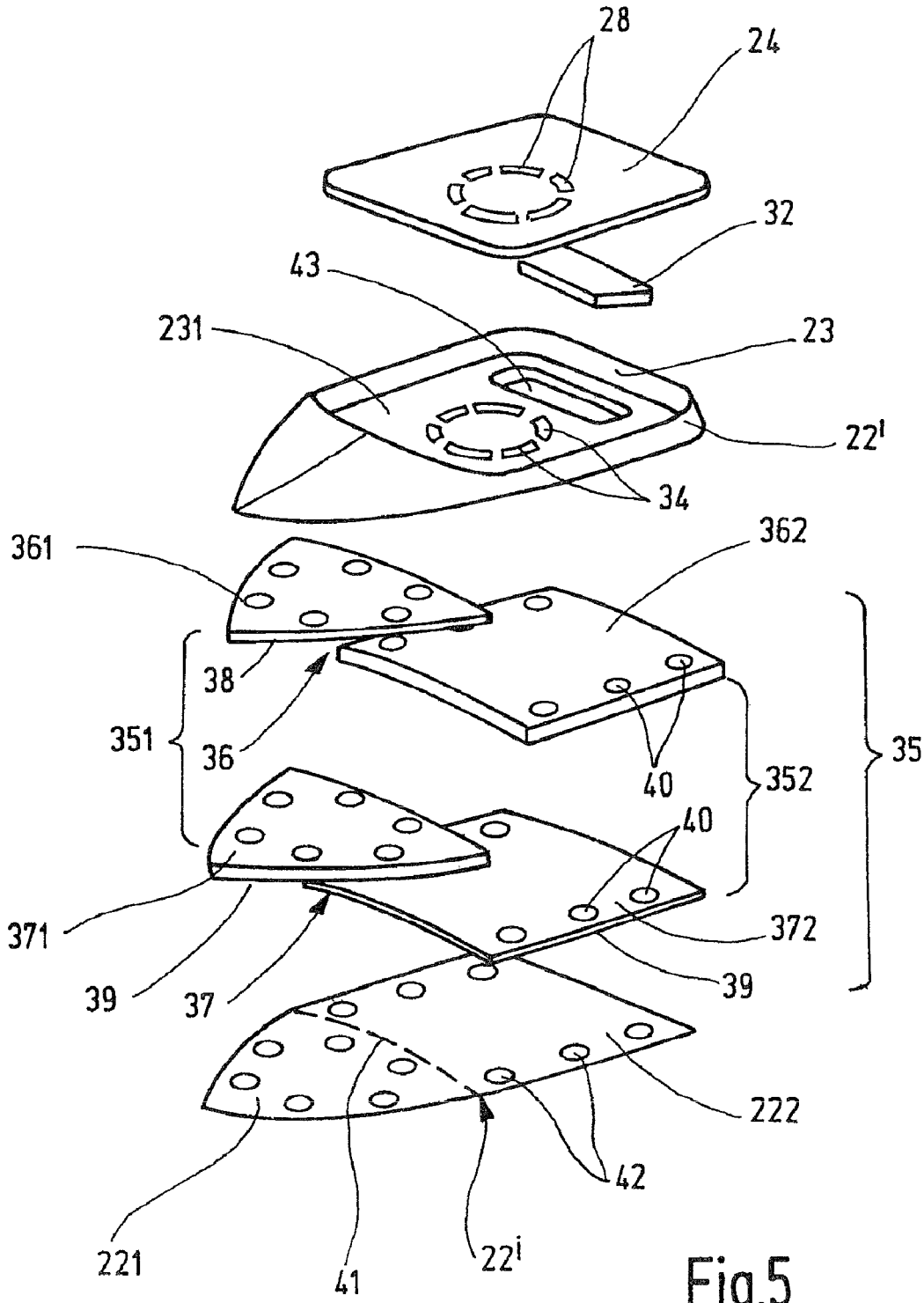
Figure 6:
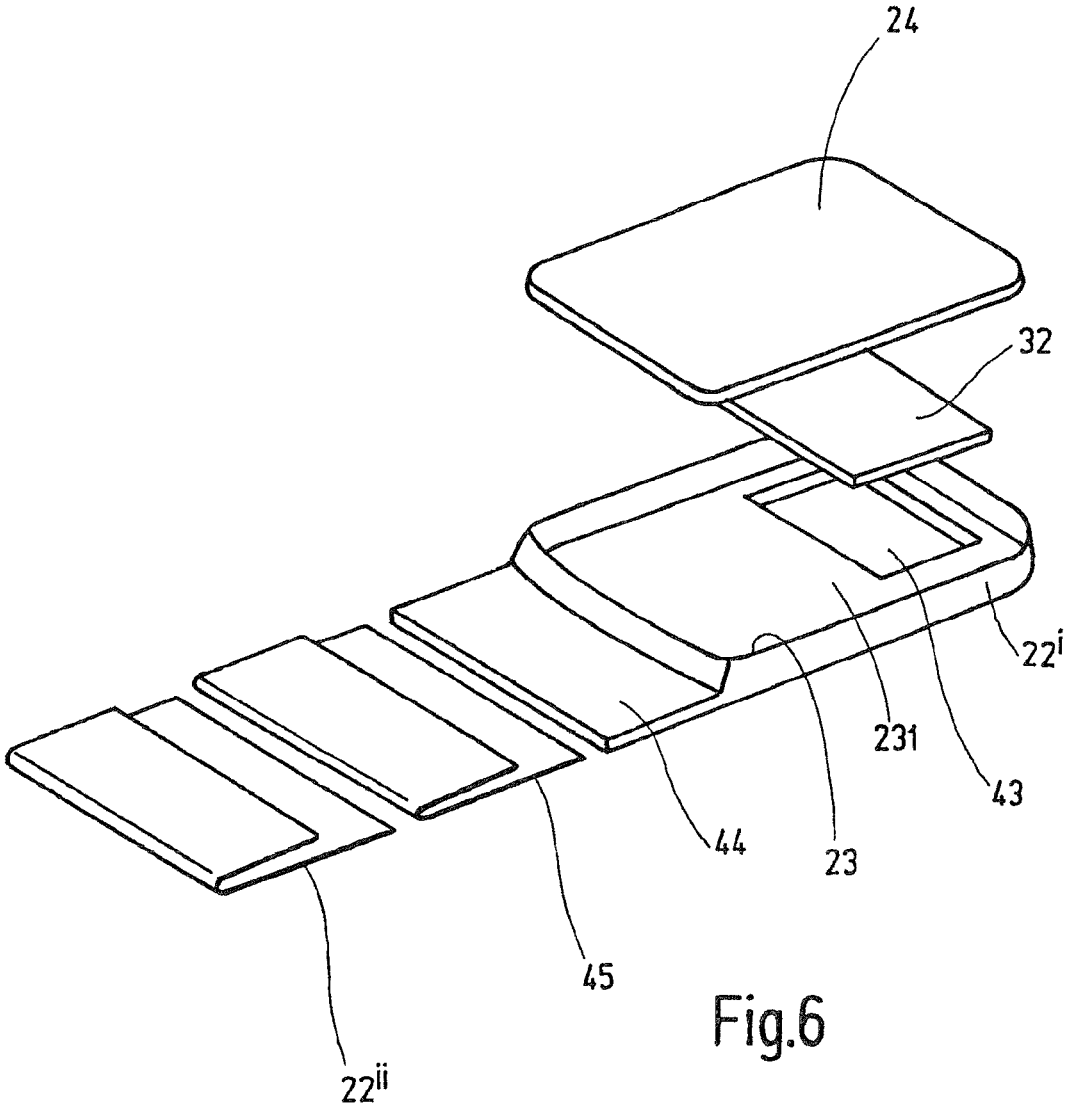

FIG. 1 shows a perspective view of an electric hand-held power tool with a dust collection container, FIG. 2 shows a section of a longitudinal sectional view along the line II-II of the electric hand-held power tool shown in FIG. 1, without the dust collection container, in an enlarged view, FIG. 3 shows an exploded depiction of a sanding plate of the electric hand-held power tool in FIGS. 1 and 2, FIG. 4 shows a perspective view of the electric hand-held power tool in FIG. 1 when installing a sanding plate according to a further exemplary embodiment, FIG. 5 shows an exploded view of the sanding plate in FIG. 4, FIG. 6 shows an exploded view of a sanding plate according to a further exemplary embodiment, for attachment to the electric hand-held power tool in FIG. 1 or 4.

DESCRIPTION OF THE EXEMPLARY EMBODIMENTS

The finishing sander, which is shown in a perspective view in FIG. 1 and in a sectional view in FIG. 2 as an exemplary embodiment of an electric hand-held power tool for performing sanding work, includes a housing 11, the housing head of which is designed as a knob 12 for gripping and guiding the finishing sander. A manually removable dust collection container 13 is attached to housing 11. Dust collection container 13 is slid over a dust outlet neck 14 (FIG. 2), via which sanding dust suctioned up from the workpiece surface using a suction fan is transported into dust collection container 13. A rectangular, preferably square drive plate 16 extends from the underside of housing 11. Drive plate 16 is supported on an eccentric peg 18 using a roller bearing 17 installed in housing 11. Eccentric peg 18 is non-rotatably mounted on an output shaft 19 of an electric motor 20 located in housing 11, which also drives a fan wheel 15 of the suction fan. Drive plate 16 is attached such that it may move elastically relative to housing 11. When eccentric peg 18 rotates, drive plate 16 performs an oscillatory motion with a superposed, orbital oscillation.

A sanding plate 21 is attached to drive plate 16 in such a manner that it may be removed without the use of tools. Sanding plate 21 is provided with means for attaching a sanding pad 22 on its underside facing away from output shaft 19. Sanding plate 21 with its means for attaching sanding pad 22 is shown in an exploded view in FIG. 3.

Sanding plate 21 includes—in its top side, which faces drive plate 16—a rectangular, preferably square, tub-shaped recess 23 with a flat tub bottom 231. The inner dimensions of recess 23 and the outer dimensions of drive plate 16 are coordinated with each other such that drive plate 16 may be accommodated in recess 23 in a form-fit manner. The means of attaching sanding plate 21—in a manner that allows it to be detached without the use of tools—to drive plate 16 is realized as a Velcro attachment between tub bottom 231 and the plate surface—which faces tub bottom 231—of sanding plate 21. Via the Velcro attachment, sanding plate 21 is securely attached to drive disk 16, and sanding plate 21 may be easily removed from drive disk 16. Tub-shaped recess 23 with a form-fit accommodation of drive plate 16 ensures that all lateral forces are transferred between drive plate 16 and sanding plate 21 in a reliable, largely wear-free manner. During the sanding procedure, the lateral forces are oriented parallel to the workpiece surface to be sanded.

To create the Velcro attachment between drive plate 16 and sanding plate 21, a velour insert 24 is attached to tub bottom 231 of recess 23, velour insert 24 preferably being bonded to tub bottom 231. The plate surface—which faces sanding plate 21—of drive plate 16 is provided with a Velcro layer 25 (FIG. 2). To suction dust, drive plate 16 is provided with concentric openings 26 (FIG. 2). Congruent openings 28 (FIG. 3), which are identical to openings 26 in drive plate 16, are provided in velour insert 24. Concentric recesses 27, which are congruent with openings 28 in velour insert 24 and openings 26 in drive plate 16, are formed in tub bottom 231 of recess 23, as are grooves 29, which extend in the manner of rays and, combined with velour insert 24 covering them, form dust-carrying channels (FIG. 3). Grooves 29 lead into recesses 27, so that, via openings 28 in velour insert 24 and openings 26 in drive plate 16, a dust-carrying connection with fan wheel 15 of suction fan is created.

With square sanding plate 21 shown in FIGS. 1 through 3, the means for attaching sanding pad 22 include a square Velcro pad 30, which has the same dimensions as sanding plate 21. Velcro pad 30 is foamed with sanding plate 21, forming a foam layer 31 between Velcro pad 30 and the underside of sanding plate 21. As shown in FIG. 2, sanding pad 22 is pressed with its velour backing against Velcro pad 30, and is therefore held securely during the sanding procedure. During the foaming process, balance weights 32, which are inserted in not-shown recesses in the underside of sanding plate 21, are also incorporated. Through-holes 33 for the passage of dust are punched in the foamed module composed of Velcro pad 30, foamed layer 31, and sanding plate 21 shown in the exploded view in FIG. 3. Through-holes 33 lead into grooves 29 in tub bottom 231 of recess 23 in sanding plate 21 and, in fact, preferably at the end of the grooves furthest from the outlets. A total of eight through-holes 33 are shown in the exemplary embodiment in FIG. 3.

Sanding plate 21 may also be rectangular in design, of course. Velcro pad 30 and foamed layer 31 would also be rectangular in this case. The contours of recess 23 would remain the same.

FIG. 4 shows the same finishing sander as in FIG. 1, with which square sanding plate 21 has been removed from drive plate 16 and replaced with a pentagonal sanding plate 21', i.e., a "penta-plate". Sanding plate 21' has a quadrangular disk section that transitions as a single piece into a triangular disk section. In the exemplary embodiment, triangular disk section is designed to be equilateral, with convexly curved lateral edges. Sanding plate 21', which is shown in an exploded view in FIG. 5 together with its means for attaching sanding pad 22', includes, in its quadrangular plate section, the same recess 23 with flat tub bottom 231 for the form-fit accommodation of drive plate 16 as does sanding plate 21 shown in FIGS. 1 through 3. Velour insert 24 is attached to tub bottom 231 for the detachable attachment of sanding plate 21' to drive plate 16, the attachment being realized using a Velcro attachment between tub bottom 231 and the adjacent plate surface of drive plate 16. Velour insert 24 interacts with Velcro layer 25 provided on drive plate 16, which has not been modified. As in FIGS. 1 through 3, velour insert 24 includes openings 28, which are congruent with openings 26 in drive plate 16, while sanding plate 21' is provided with identical, concentrically located openings 34, which are congruent with openings 28 in velour insert 24 and openings 26 in drive plate 16. Not-shown grooves are formed in the underside—which faces away from drive plate 16—of sanding plate 21', which lead into concentric openings 34 and extend in the manner of rays. The grooves are covered by an intermediate layer 35 attached to the underside of sanding plate 21', thereby forming dust-suction channels. Intermediate layer 35 is the means for attaching sanding pad 22' to sanding plate 21' and, to this end, it is provided with a Velcro layer 39 on the underside, which faces away from sanding plate 21'. Intermediate layer 35 is composed of a rear—relative to the working direction—quadrangular layer part 352 and, aligned therewith, a front, triangular layer part 351. The front, triangular layer part 351 is equilateral in design with convexly curved lateral edges, in conformance with the front triangular section of sanding plate 21'. Intermediate layer 35 also includes a top layer 36, which is composed in the same manner and is bonded to the underside of sanding plate 21', and a lower layer 37, which is also composed in the same manner, carries Velcro layer 39, and is attached to top layer 36. Front, triangular layer part 371 of lower layer 37 is detachably attached to front, triangular layer part 361 of top layer 36. Rear, quandrangular layer part 372 of lower layer 37 is non-detachably attached to rear, quadrangular layer part 362 of top layer 36. The detachable connection is realized using a Velcro layer 38 on front layer part 361 of top layer 36, and using a velour backing of front layer part 371 of lower layer 37. The non-detachable connection of two rear layer parts 362 and 372 is realized via bonding. Intermediate layer 35 is provided with through-holes 40, which serve to carry away dust. Each through-hole 40 extends into a groove that leads into openings 34, and, in fact, preferably at the end of the grooves opposite to their outlets. In addition, sanding pad 22'—as is sanding pad 22 in FIGS. 1 and 2—is provided with dust passages 42, which are congruent with through-holes 40 when sanding pad 22' is installed on intermediate layer 35.

Pentagonal sanding pad 22', which has been attached via its velour backing to Velcro layer 39 on underside 37, includes a rear, quadrangular pad section 222 that is congruent with rear, quadrangular layer part 352 of intermediate layer 35, and a front, triangular pad section 221, which is congruent with front, triangular layer part 351 of intermediate layer 35. A perforation 41 extends between front and rear pad sections 221 and 222, via which pad sections 221 and 222 may be easily separated. By dividing intermediate layer 35 into front, triangular layer section 351 and rear, quadrangular layer section 352, and into upper layer 36 and lower layer 37, if the tip region of intermediate layer 35 becomes worn, front layer part 371 of lower layer 37 may be separated from front layer part 361 of top layer 36, so that it may be rotated 120° and reinstalled on front layer part 361 of top layer 36. When front layer part 371 becomes worn, it is therefore possible to rotate lower layer 37 by 120° twice. In the same manner, when only the tip region of sanding pad 22' becomes worn, front sanding pad section 221 may be torn away from rear sanding pad section 222 via perforation 41, rotated by 120° and then pressed back onto Velcro layer 39 on front layer section 351. A balance weight 32 is accommodated in sanding plate 21'. Balance weight 32 is inserted in a recess 43 formed in tub bottom 231, and it is attached in recess 43 via velour insert 24 bonded to tub bottom 231.

With sanding plate 21" shown in an exploded view in FIG. 6, the finishing sander in FIGS. 1 and 4 may be coverted to a flap sander for sanding slatted doors, lamella gratings, or the like. Sanding plate 22"—which may be installed on drive plate 16 in the same manner described, in a form-fit manner via its recess 23, and which is attachable to drive plate 16' via a Velcro attachment, includes a sanding tab 44, which extends as one piece from the plate part with recess 23, is rectangular in design in the exemplary embodiment, and includes a Velcro layer on the underside and top side. The Velcro layer is formed by a flexible Velcro strip 45, which extends over the front edge of sanding tab 44 and is attached to the underside and top side of sanding tab 44 via bonding. The required balance weight 32 is inserted in a recess 43 in tub bottom 231 of recess 23, and it is secured from falling out using velour insert 24 bonded to tub bottom 231. Velour insert 24 and Velcro layer 25 on the plate surface of drive plate 16 (FIG. 2) create the adhesive Velcro connection between sanding plate 21" and drive plate 16.

In all of the exemplary embodiment described, sanding plate 21, 21' and 21" is made of plastic, and it is preferably composed of a fiberglass-reinforced polyamide.

In all of the exemplary embodiments described, balance weights 32 may be eliminated if the same center of mass is created as results from the use of balance weights 32 by designing sanding plate 21, 21' and 21" accordingly.

What is claimed is:

1. An electric hand-held power tool for performing sanding work, in particular a finishing sander, with a drive plate (16)—which is drivable in a sanding motion using an electric motor—and a sanding plate (21; 21', 21") attached thereto such that it is removable without the use of a tool, and which includes means for attaching a sanding pad (22; 22', 22"), wherein the sanding plate (21; 21', 21") has an axis, extends in a sanding plate plane which is transverse to the axis, and includes—in its top side facing the drive plate (16)—a tub-shaped recess (23) with a flat tub bottom (231) for receiving the drive plate (16) in a form-fit manner, and the sanding plate (21; 21', 21") is detachably attached to the drive plate (16) between the tub bottom (231) and a disk surface of the drive plate (16) facing the tub bottom (231) by press fitting the drive plate (16) into the tub-shaped recess (23) from above in a direction transverse to the sanding plate plane.

2. The electric hand-held power tool as recited in claim 1, wherein the sanding plate (21) is rectangular, and preferably square, in design.

3. The electric hand-held power tool as recited in claim 2, wherein the means for attaching the sanding pad (22) includes a Velcro pad (30), and wherein foam is applied to the Velcro pad (30) and an underside of the sanding plate (21), forming a foam layer (31) between the Velcro pad (30) and the underside of the sanding plate (21).

4. The electric hand-held power tool as recited in claim 3, wherein at least one balance weight (32) is inserted in at least one recess (46) in the underside of the sanding plate (21), and upon which foam is applied.

5. The electric hand-held power tool as recited in claim 3, wherein the tub bottom (231) is provided with recesses (27), which are congruent with openings (28) in a velour insert (24), and with grooves that lead into the openings (28), wherein the grooves form dust-carrying channels, which are covered by the velour insert (24) and extend in a ray-like manner.

6. The electric hand-held power tool as recited in claim 5, wherein a plurality of through-holes (33) for carrying away dust are formed—preferably punched—in a foamed module composed of the Velcro pad (30), the foam layer (31) and the sanding plate (21), one of which leads into a groove in the sanding plate (21).

7. The electric hand-held power tool as recited in claim 5, wherein the tub bottom (231) of the recess (23) formed in the sanding plate (21') is provided with concentric openings (34) that are congruent with the openings (28) in the velour insert (24), and grooves, which lead in the concentric openings (34), are formed in the underside—facing away from the drive plate (16)—of the sanding plate (21') and wherein the grooves form dust-carrying channels, which are covered by a top layer (36) of an intermediate layer (35) and extend in a ray-like manner.

8. The electric hand-held power tool as recited in claim 7, wherein through-holes (40), which serve to carry away dust, are formed in the intermediate layer (35), and wherein each through-hole (40) ends in one of the grooves, which ends are located a furthest distance from an outlet.

9. The electric hand-held power tool as recited in claim 8, characterized by a pentagonal sanding pad (22') that is attachable to the sanding plate (21'), wherein the sanding pad (22') includes a rear, quadrangular pad section (222), which is congruent with a rear, quadrangular layer part (352) of the intermediate layer (35), and a front, triangular pad section (221), which is congruent with a front, triangular layer part (351) of the intermediate layer (35), it being possible to separate two pad sections (221, 222) at a perforation in the sanding pad (22').

10. The electric hand-held power tool as recited in claim 1, wherein the sanding plate (21') is designed with five corners and includes a front tip region, relative to the working direction, and wherein the front tip region of the sanding plate (21') is an equilateral triangle with convexly curved lateral edges.

11. The electric hand-held power tool as recited in claim 10, wherein the means for attaching the sanding pad (22') includes an intermediate layer (35), which is attached to the underside of the sanding plate (21') and includes a Velcro layer (39), wherein the intermediate layer (35) is composed of a rear quadrangular layer part (352), with respect to a working direction and, aligned therewith, a front, triangular layer part (351), which triangular layer part (351) is equilateral with convexly curved lateral edges.

12. The electric hand-held power tool as recited in claim 11, wherein the intermediate layer (35) includes a top layer (36), which is attached to the underside of the sanding plate (21'), and is preferably bonded thereto, and a lower layer (37), on which the Velcro layer (39) is installed and which is attached to the top layer (36); a front, triangular layer part (361) of the lower layer (37) is attached to the front, triangular layer part (361) of the top layer (36) in a detachable manner—preferably via a Velcro attachment—and a rear, quadrangular layer part (372) of the lower layer (37) is attached to a rear, quadrangular layer part (362) of the top layer (36) in a detachable manner, preferably via bonding.

13. The electric hand-held power tool as recited in claim 12, wherein a Velcro layer (38) is located on the underside—facing the sanding plate (21')—of the front, triangular layer part (361) of the top layer (36), and the front, triangular layer part (371) of the lower layer (38) includes a velour backing.

14. The electric hand-held power tool as recited in claim 10, wherein at least one notch (43) for receiving at least one balance weight (32) is formed in the tub bottom (231) of the recess (23) formed in the sanding plate (21'; 21").

15. The electric hand-held power tool as recited in claim 1, wherein the sanding plate (21; 21', 21") is made of plastic and is preferably composed of fiberglass-reinforced polyamide.

16. An electric hand-held power tool for performing sanding work, in particular a finishing sander, with a drive plate (16) that is drivable in a sanding motion using an electric motor and a sanding plate (21; 21', 21") attached thereto such that it is removable without the use of a tool, and which includes means for attaching a sanding pad (22; 22', 22"), wherein the sanding plate (21; 21', 21") includes, in its top side facing the drive plate (16), a tub-shaped recess (23) with a flat tub bottom (231) for receiving the drive plate (16) in a form-fit manner, wherein the sanding plate (21; 21', 21") is detachably attached to the drive plate (16) between the tub bottom (231) and a disk surface of the drive plate (16) facing the tub bottom (231), and wherein the attachment between the tub bottom (231) and the surface of the drive plate (16), which may be detached without the use of tools, comprises—Velcro.

17. The electric hand-held power tool as recited in claim 16, wherein a velour insert (24) is attached to the tub bottom (231) of the recess (23) formed in the sanding plate (21; 21', 21"), and is preferably bonded thereto, and the surface of the drive plate (16) is provided with a Velcro layer (25).

18. The electric hand-held power tool as recited in claim 17, wherein the drive plate (16) and the velour insert (24) include concentric, congruent openings (26, 28) for suctioning dust.

19. An electric hand-held power tool for performing sanding work, in particular a finishing sander, with a drive plate (16) that is drivable in a sanding motion using an electric motor and a sanding plate (21; 21', 21") attached thereto such that it is removable without the use of a tool, and which includes means for attaching a sanding pad (22; 22', 22"), wherein the sanding plate (21; 21', 21") includes, in its top side facing the drive plate (16), a tub-shaped recess (23) with a flat tub bottom (231) for receiving the drive plate (16) in a form-fit manner, wherein the sanding plate (21; 21', 21") is detachably attached to the drive plate (16) between the tub bottom (231) and a disk surface of the drive plate (16) facing the tub bottom (231), and wherein the sanding plate (21; 21', 21") includes at least one balance weight (32).

20. An electric hand-held power tool for performing sanding work, in particular a finishing sander, with a drive plate (16) that is drivable in a sanding motion using an electric motor and a sanding plate (21; 21', 21") attached thereto such that it is removable without the use of a tool, and which includes means for attaching a sanding pad (22; 22', 22"), wherein the sanding plate (21; 21', 21") includes, in its top side facing the drive plate (16), a tub-shaped recess (23) with a flat tub bottom (231) for receiving the drive plate (16) in a form-fit manner, wherein the sanding plate (21; 21', 21") is detachably attached to the drive plate (16) between the tub bottom (231) and a disk surface of the drive plate (16) facing the tub bottom (231), and wherein the sanding plate (21") is rectangular in design and includes a preferably rectangular sanding tab (44) that projects as one piece in a working direction.

21. The electric hand-held power tool as recited in claim 20, wherein a Velcro layer is provided on at least the underside of the sanding tab (44) and the top side of the sanding tab (44).

22. The electric hand-held power tool as recited in claim 21, wherein the Velcro layer is formed by a flexible Velcro strip (45) that covers a front edge of the sanding tab (44) and is attached—preferably bonded—to the underside of the sanding tab (44) and to the top side of the sanding tab (44).

* * * * *